United States Patent [19]

Bangel et al.

[11] Patent Number: 5,037,270

[45] Date of Patent: Aug. 6, 1991

[54] HIGH PRESSURE/TEMPERATURE STEAM PASSAGE FOR STEAM TURBINES IN DOUBLE SHELL HOUSING DESIGN

[75] Inventors: Friedhelm Bangel, Oberhausen; Klaus Buchkremer, Hilden; Dieter Forster, Schillingsfürst; Achim Zimmermann, Mühleim; Heinz-Dieter Tremmel, Nuremberg, all of Fed. Rep. of Germany

[73] Assignee: MAN Gutehoffnungshütte Aktiengesellschaft, Oberhausen, Fed. Rep. of Germany

[21] Appl. No.: 483,246

[22] Filed: Feb. 22, 1990

[30] Foreign Application Priority Data

Feb. 25, 1989 [DE] Fed. Rep. of Germany ..... 3905900

[51] Int. Cl.[5] ..... F01D 25/26

[52] U.S. Cl. ..... 415/134; 415/108; 415/136

[58] Field of Search ..... 415/108, 134, 136, 137, 415/138; 285/370

[56] References Cited

U.S. PATENT DOCUMENTS

| | | | |
|---|---|---|---|
| 2,800,299 | 7/1957 | Sheppard | 415/136 |
| 4,697,983 | 10/1987 | Yamaguchi | 415/134 |
| 4,750,861 | 6/1988 | Baker | 415/134 |
| 4,772,178 | 9/1988 | Miller | 415/136 |
| 4,812,105 | 3/1989 | Heymann | 415/136 |

FOREIGN PATENT DOCUMENTS

| | | | |
|---|---|---|---|
| 1077229 | 3/1960 | Fed. Rep. of Germany | 415/108 |
| 995276 | 11/1951 | France | 415/108 |
| 1138526 | 2/1985 | U.S.S.R. | 415/108 |
| 718534 | 11/1954 | United Kingdom | 415/134 |

*Primary Examiner*—John T. Kwon

*Attorney, Agent, or Firm*—McGlew & Tuttle

[57] ABSTRACT

A live steam passage of double-shell design for steam turbines is disclosed. According to the present invention, the steam passage is welded as a welded-in insert (1) onto the outer housing (9) of the turbine. The piston ring supoprt sleeve (2) with the piston rings (4) slides as a separate part in a sleeve (5), which the sleeve (2) is screwed onto the welded-in insert (1) with locking screws (3). A threaded ring (6) provided with a high collar holds the sleeve (5) in place in the inner housing (7) of the turbine. The live steam passage according to the present invention can be used in steam turbines, including throttle-controlled steam turbines with inner housings.

6 Claims, 1 Drawing Sheet

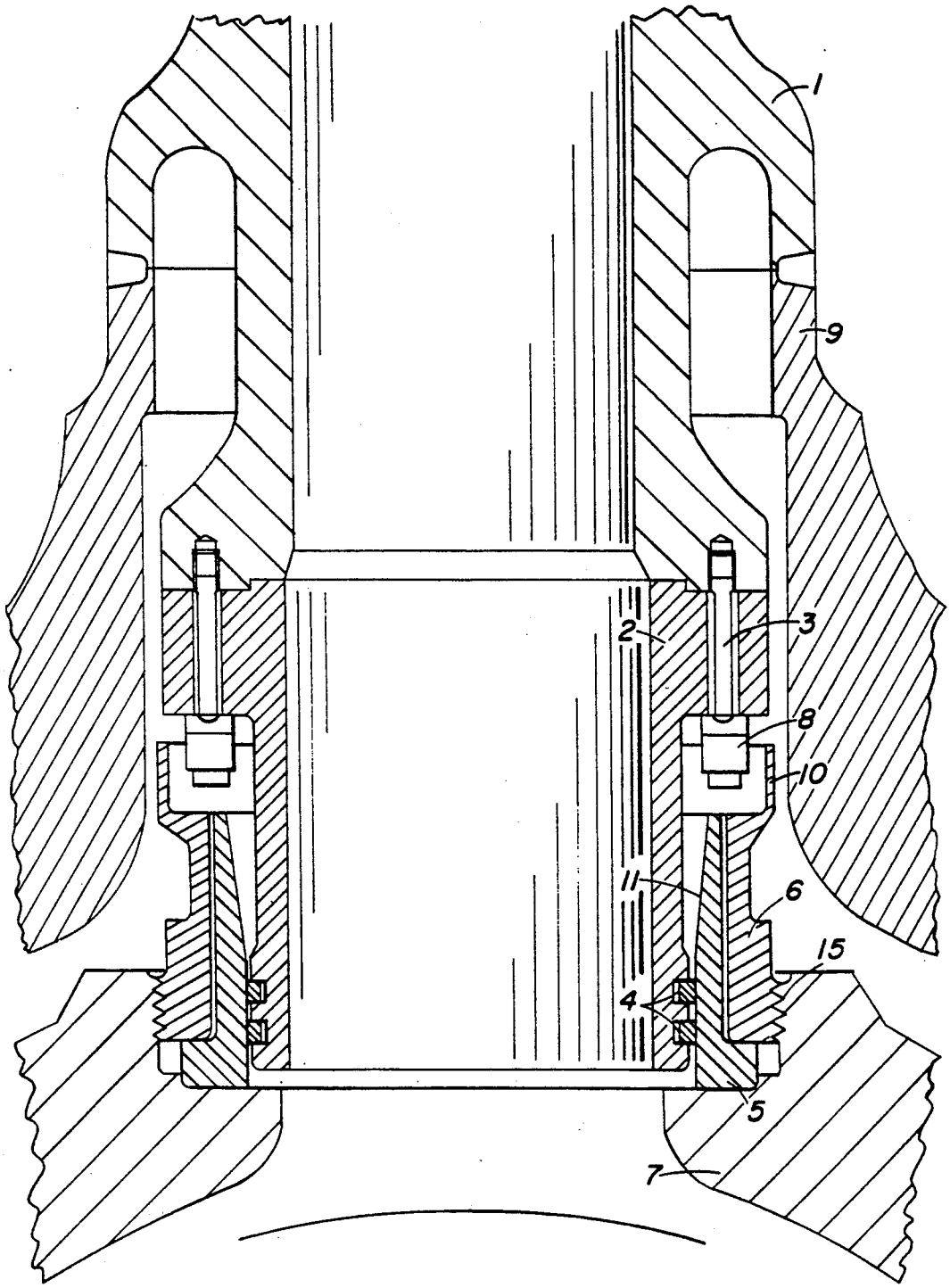
1
9
2
3
8
10
11
6
15
4
5
7

HIGH PRESSURE/TEMPERATURE STEAM PASSAGE FOR STEAM TURBINES IN DOUBLE SHELL HOUSING DESIGN

FIELD AND BACKGROUND OF THE INVENTION

The present invention pertains to a live steam (high temperature/pressure steam) passage that is movable under the effect of heat between the inner housing and the outer housing of a steam turbine via a piston ring connection.

In steam turbines which are designed for higher pressures and/or temperatures, the so-called double-shell design is used, in which an inner housing is mounted within the outer housing. In this design, there are temperature and pressure gradients from the inside to the outside, as a result of which the load on the individual housing parts is limited in accordance with such gradients.

Because the expansion and the shrinkage of the outer housing and the inner housing are different during the different phases of operation, it is necessary to make the steam-tight connection between the two housing parts elastic.

Consequently, it is known that in steam turbines, the steam being admitted can be sent directly into the inner housing by means of a sealed passage through the outer housing, and the steam first performs its work of expansion in the inner housing. In this design, the outer housing comes into contact only with the steam being discharged from the inner housing.

Consequently, designs with an inner housing in steam turbines belong to the state of the art, and they are conventionally designed as L-ring or angle ring connections, I-ring connections, or piston ring connections.

Angle ring connections have the disadvantage that their manufacture is complicated and expensive, because double seating surfaces with high accuracy of fit must be prepared on both the ring and the annular seats.

A disadvantage of the I-ring connection is the fact that the ring is unable to accommodate any relative movements in its plane. Therefore, it can be used only with limitations.

Piston ring connections have been used so far in two different designs:

As a loose double piston ring sleeve, which carries piston rings on each side, by means of which it must seal in both the outer housing and the inner housing of the turbine. This implies the risk of additional leaks.

Single piston ring seal design, which seals only in the inner housing, while the piston rings sit on an inlet a nozzle element or connection piece welded rigidly to the outer housing, is problematic in terms of manufacture, because the piston ring grooves can be prepared only after the inlet connection piece has been welded in during the machining of the housing halves of the turbine. This may require special tools for reasons of accessibility, especially in the case of smaller turbines with smaller housing diameters.

SUMMARY AND OBJECTS OF THE INVENTION

It is an object of the present invention to improve a single piston ring connection for the live steam passage on steam turbines so that an inexpensive, easy-to-maintain, and reliable means for admission of the live or high pressure/temperature steam through the outer housing to said inner housing of a steam turbine is obtained.

According to the invention, a movable live steam passage for high pressure/temperature steam is provided between an inner housing and an outer housing of a steam turbine, the passage being movable under the effect of heat or a heat differential between the inner housing and the outer housing. The arrangement provides a piston ring connection. A welded-in insert is welded into an opening in the outer housing of the turbine. A separate piston ring supporting sleeve is screwed onto the welded-in insert by locking screws. A sleeve is provided as counterpart to piston rings. Piston rings attached to the supporting sleeve engage the inner sliding surface of the sleeve. The sleeve as counterpart to piston rings is held in place in the inner housing of the turbine by a threaded ring which threadedly engages the inner housing of the turbine. A threaded ring is designed as a protective cover for the piston ring connection which is favorable for flow. A threaded ring is provided with an external collar which surrounds capped nuts provided on the locking screws. The sleeve as counterpart to piston rings is provided with an oblique junction section. The welded-in connection piece is machined only on the end face after it is welded in.

The live steam passage according to the present invention guarantees a good possibility of replacement of the individual parts in the case of wear, and at the same time the piston ring sealing surfaces are minimized. In addition, the design according to the present invention is self-protecting in the case of rupture of the locking screws of the piston ring sleeve because the screw ends and nuts are retained.

The design according to the present invention has the following specific advantages:

After welding in, the welded-in connection piece only needs to be machined on its end face during the machining of the corresponding housing halves, i.e., only turning of the fitting and seating surfaces and drilling of the threaded holes are required.

Simple replacement of the piston ring support sleeve at the site of installation of the turbine. Remachining of the outer housing (and of the inner housing) is eliminated in the case of wear on the piston ring seal.

The use of screw bolts with units for screwing on the piston ring sleeve guarantees problem-free separation of the connection in the case of replacement, even after a long operating time.

The reduced shaft (elastic shaft of the locking screws) compensates for changes in length between the cold screw and the hot sleeve during start-up.

Simple machining of the piston ring support sleeve, which is a separate part, in terms of the fitting and seating surfaces and the piston ring grooves is provided.

Finally, the stocking of all separate parts is unproblematic.

Because the capped nuts of the locking screws are secured by the threaded ring collar after assembly, the capped nut cannot fall into the blading of the turbine in the case of rupture of the locking screw, which would cause considerable damage.

The threaded ring is designed as a protective cover for the piston ring connection, which is favorable for flow. The entire piston ring connection is therefore located in the dead water zone of the steam turbine, which is neutral with respect to excitation. This is particularly important when its own discharged steam flows outside the inner housing in the opposite direction.

The threaded ring, designed as a flow guide cover, also prevents temperature differences over the wall thickness of the piston ring support sleeves reaching the magnitude of the difference between the steam inlet temperature and the inner housing discharge temperature from occurring. The lower this temperature difference can be kept, the lower is also the tensile stress resulting from the temperature difference in the axial direction of the piston ring sleeve at the bottom of the piston ring grooves, i.e., where the highest stress occurs because of the notch effect.

The only figure in the patent shows a sectional view through the axial plane of the steam passage, omitting the parts that are not essential for understanding.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only Figure is a sectional view through the axial plane of the steam passage, omitting the parts that are not essential for understanding.

DETAILED DESCRIPTION OF THE PREFERRED EMBODIMENT

A welded-in insert 1 is placed in the opening of the outer housing 9 of a steam turbine (not shown in greater detail), and is welded to the outer housing 9. After welding, the welded-in insert needs to be machined, together with the corresponding turbine housing half, only on its end face.

The piston ring support sleeve 2 with the piston rings 4 slides as a separate part in the sleeve 5 as the counter part. The piston ring support sleeve requires only a simple machining of the fitting and seating surfaces of sleeves and piston ring sleeves.

The piston ring support sleeve 2 is screwed onto the welded-in insert 1 with locking screws 3. The locking screws carry capped nuts 8.

Said support sleeve 5 is provided with an oblique junction section, which has an angle of 7° in the embodiment. A threaded ring 6 is used to hold in place said sleeve 5 in said inner housing 7 of the steam turbine.

The threaded ring 6 has a high collar which surrounds the capped nuts 8. In the case of rupture of locking screws, separate capped nuts or screw parts that may be present are caught in the collar and cannot enter as foreign bodies into the turbine blades.

While a specific embodiment of the invention has been shown and described in detail to illustrate the application of the principles of the invention, it will be understood that the invention may be embodied otherwise without departing from such principles.

What is claimed is:

1. A high pressure/temperature steam passage movable under the effect of heat between an inner housing and an outer housing of a steam turbine, comprising: a welded-in insert connected into an opening of the outer housing of the turbine; a piston ring supporting sleeve screwed onto said welded-in insert via locking screws, said piston ring supporting sleeve receiving piston rings; a sleeve forming a counter part to said piston rings, said sleeve having an inner surface, said piston ring sliding on said inner surface of said sleeve; and, a threaded ring threadedly engaged with an opening of said inner housing and engaging said sleeve to hold said sleeve in place relative to said inner housing.

2. A high pressure/temperature steam passage according to claim 1, wherein said threaded ring is designed as a protective cover exposed to steam flow, said threaded ring having a surface favorable for flow in providing little resistance to flow.

3. A high pressure/temperature steam passage according to claim 1, wherein said threaded ring includes an external collar portion surrounding capped nuts connected to said locking screws.

4. A high pressure/temperature steam passage according to claim 1, wherein said sleeve as the counter part includes an oblique junction section.

5. A high pressure/temperature steam passage according to claim 1, wherein said welded-in connection piece is machined only on an end face after it has been welded to said outer housing.

6. A high pressure/temperature steam passage movable with expansion under the effect of heat of a steam turbine, comprising: an inner housing; an outer housing having an opening, said inner housing having an opening substantially aligned with said outer housing; an insert member having a surface welded to said outer housing at said outer housing opening; a threaded ring having a threaded portion, said inner housing opening having a threaded portion complimenting said threaded ring threaded portion; a sleeve defining an interior cylinder surface said sleeve having a flange, said inner housing having a lip defining a seat receiving said sleeve adjacent said flange, said sleeve being fixed to said inner housing upon said threaded ring threaded portion engaging said inner housing threaded portion; a piston ring supporting sleeve having a base flange fixed to said welded-insert via screw members; and, piston rings provided in grooves about an exterior surface of said piston rings supporting sleeve, said piston rings having an exterior surface engaging the inner surface of said sleeve.

* * * * *